US006367385B2

(12) United States Patent
Komori

(10) Patent No.: US 6,367,385 B2
(45) **Date of Patent: *Apr. 9, 2002**

(54) INK FILM THICKNESS CONTROL METHOD AND APPARATUS FOR MULTI-COLOR PRINTING PRESS

(75) Inventor: Tatsuo Komori, Ibaragi (JP)

(73) Assignee: Komori Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/387,351

(22) Filed: Aug. 31, 1999

(30) Foreign Application Priority Data

Sep. 2, 1998 (JP) ..... 10-248444

(51) Int. Cl.[7] ..... B41F 31/04
(52) U.S. Cl. ..... 101/484; 101/365
(58) Field of Search ..... 101/350.1–350.4, 101/351.3, 352.01, 352.05, 352.09, 365, 483–485, DIG. 32, DIG. 38

(56) References Cited

U.S. PATENT DOCUMENTS

| | | | |
|---|---|---|---|
| 5,010,820 | A | 4/1991 | Loeffler |
| 5,174,210 | A | 12/1992 | Rodi et al. |
| 5,447,102 | A | 9/1995 | Pfeiffer et al. |
| 5,884,562 | A | 3/1999 | Sugiyama et al. |

*Primary Examiner*—Eugene Eickholt
(74) *Attorney, Agent, or Firm*—Blakely Sokoloff Taylor & Zafman

(57) ABSTRACT

In an ink film thickness control method for a multi-color printing press having a plurality of printing units for continuously performing designated color printing on a printing paper by means of ink supplied to a printing plate through an ink roller group, when in at least two of the printing units are plate exchange printing units, exchange to new printing plates are simultaneously performed, the number of printing sheets to be printed for ink removing is set in units of plate exchange printing units. The ink feed operation in each plate exchange printing unit is turned off. Printing for ink removing is performed in each plate exchange printing unit on the basis of the set number of printing sheets while keeping the previous printing plate mounted, thereby forming a first ink film thickness distribution minimum and necessary for printing on the ink roller group of the plate exchange printing unit. An ink film thickness control apparatus is also disclosed.

14 Claims, 7 Drawing Sheets

INK FILM THICKNESS CONTROL METHOD AND APPARATUS FOR MULTI-COLOR PRINTING PRESS

BACKGROUND OF THE INVENTION

The present invention relates to an ink film thickness control method and apparatus used in exchanging a printing plate in a multi-color printing press having a plurality of printing units each of which supplies ink in an ink fountain to a printing plate through an ink roller group and prints the ink supplied to the printing plate on printing paper.

FIG. 8 shows the main part of an ink supply apparatus in each printing unit (printing section) of a multi-color printing press. Referring to FIG. 8, reference numeral 1 denotes an ink fountain; 2, ink stored in ink fountain 1; 3, an ink fountain roller; 4, a plurality of ink fountain keys juxtaposed along the axial direction of ink fountain roller 3; 5, an ink ductor roller; 6, an ink roller group; 6A, ink from rollers in the ink roller group 6; 7, a printing plate; and 8, a plate cylinder.

In the ink supply apparatus having the above arrangement, the ink 2 in ink fountain 1 is supplied by adjusting the aperture ratios of ink fountain keys 4. The ink supplied to ink fountain roller 3 is supplied to printing plate 7 via ink roller group 6 by feed operation of ink ductor roller 5. Printing paper fed from a paper feed section is printed with the ink supplied to printing plate 7.

When the printing plate is changed to a new printing plate 7, the aperture ratio of each ink fountain key 4 and the rotation ratio of the ink fountain roller 3 are preset to values corresponding to the image of the printing plate 7. More specifically, the aperture ratio of each ink fountain key 4 and the rotation ratio of ink fountain roller 3 are set to values corresponding to the image of printing plate 7, and the ink 2 in ink fountain 1 is supplied to new printing plate 7 via ink roller group 6. In this case, test printing is performed before final printing to adjust the ink supply amount, thereby obtaining a satisfactory color tone. With this operation, a desired ink film thickness distribution (gradient of thickness of the ink film) is formed on ink roller group 6.

In the conventional ink supply apparatus, however, when the printing plate is exchanged with new printing plate 7, the ink film thickness distribution for the previous printing plate remains on ink roller group 6. In this case, the ink film thickness distribution for the previous printing plate must be gradually changed to the ink film thickness distribution for printing plate 7. This operation requires excessive adjustment of the ink supply amount and test printing until a satisfactory color tone is obtained. The excessive adjustments of ink supply amount required by this operation results in problems including an increase in preparation time for printing, an increase in work load, waste of printing materials, a decrease in production efficiency, and increase in cost.

"INK FILM THICKNESS CONTROL METHOD FOR INK SUPPLY APPARATUS" is proposed in U.S. Pat. No. 5,884,562 for the purpose of decreasing the number of times ink supply amount is adjusted and test printing is performed until a satisfactory color tone is obtained. In this ink film thickness control method, "ink removing" is performed before exchanging the printing plate with a new printing plate.

This will be described in detail. After final printing using a printing plate, a printing unit is selected on a display (not shown). The "ink removing" mode (function) is selected, and the feed operation of ink ductor roller 5 is stopped. The printing press is operated while keeping the printing plate mounted, thereby printing a predetermined number of paper sheets. With this operation, a minimum ink film thickness distribution Ma (FIG. 7A; to be referred to as a first ink film thickness distribution hereinafter) necessary for printing is left on ink roller group 6 such that the ink film thickness decreases from the upstream to the downstream. More specifically, an ink film thickness distribution corresponding to the image of the printing plate is removed from the ink film thickness distribution formed on ink roller group 6, and the first ink film thickness distribution Ma corresponding to the no-image portion of the printing plate is left.

After the printing plate is changed to a new printing plate 7, the "pre-inking II" function is selected on the display to perform the "pre-inking II" operation. In "pre-inking II", the aperture ratios of ink fountain keys 4 and the rotation ratio of ink fountain roller 3 are preset to values corresponding to the image of printing plate 7. After this, the printing press is operated. Ink ductor roller 5 is caused to perform the feed operation a predetermined number of times to superpose an ink film thickness distribution Mb (FIG. 7B; to be referred to as a second ink film thickness distribution hereinafter) corresponding to the image of new printing plate 7 on the first ink film thickness distribution Ma left on ink roller group 6.

After second film thickness distribution Mb is superposed on first ink film thickness distribution Ma, a predetermined number of sheets are test-printed. The density of the test-printed matters is checked. If the color tone is satisfactory, ink film thickness control by "ink removing+pre-inking II" is ended, and the operation shifts to final printing. On the other hand, if the color tone checked by density check is not satisfactory, the ink film thickness distribution is finely adjusted by "pre-inking (+)" or "pre-inking (−)", and test-printing is performed again.

In this proposed method, however, when printing plates for the plurality of printing units are simultaneously exchanged, the printing units print the same number of printing sheets conveyed from a feed section upon "ink removing" in the respective printing units. At this time, because of ink trapping (a phenomenon wherein ink of early printing is superposed on ink of succeeding printing), the upstream printing units have too little ink while ink in the downstream printing units does not decrease. For this reason, a satisfactory ink film thickness distribution cannot be formed for the subsequent printing operation, and the amount of paper wasted in the transition to the new printing plate increases.

SUMMARY OF THE INVENTION

It is an object of the present invention to provide an ink film thickness control method and apparatus for a multi-color printing press, which accurately form an ink film thickness distribution for the next printing operation to prevent waste paper.

It is another object of the present invention to provide an ink film thickness control method and apparatus for a multi-color printing press, which can appropriately perform "ink removing" in each of printing units which simultaneously exchange printing plates.

In order to achieve the above objects, according to the present invention, there is provided an ink film thickness control method for a multi-color printing press. The printing press has a plurality of printing units for continuously performing designated color printing on a printing paper by means of ink supplied to a printing plate through an ink roller group. The method includes the steps of when at least two of the printing units, as plate exchange printing units, exchange to new printing plates are simultaneously performed, setting the number of printing sheets to be printed for ink removing in units of plate exchange printing units of at least two printing units of the printing press, turning off an ink feed operation in each of the plate exchange printing units, and performing printing for ink removing in each of the plate exchange printing units on the basis of the set number of printing sheets while keeping the previous printing plate mounted. The method can include exchange of printing plates used at the at least two printing units with second printing plates to be used at the at least two printing units. The method is employed to form a first ink film thickness distribution minimum necessary for printing on the ink roller group of the plate exchange printing unit.

DESCRIPTION OF THE PREFERRED EMBODIMENTS

The present invention will be described below in detail with reference to the accompanying drawings.

Figure 2:
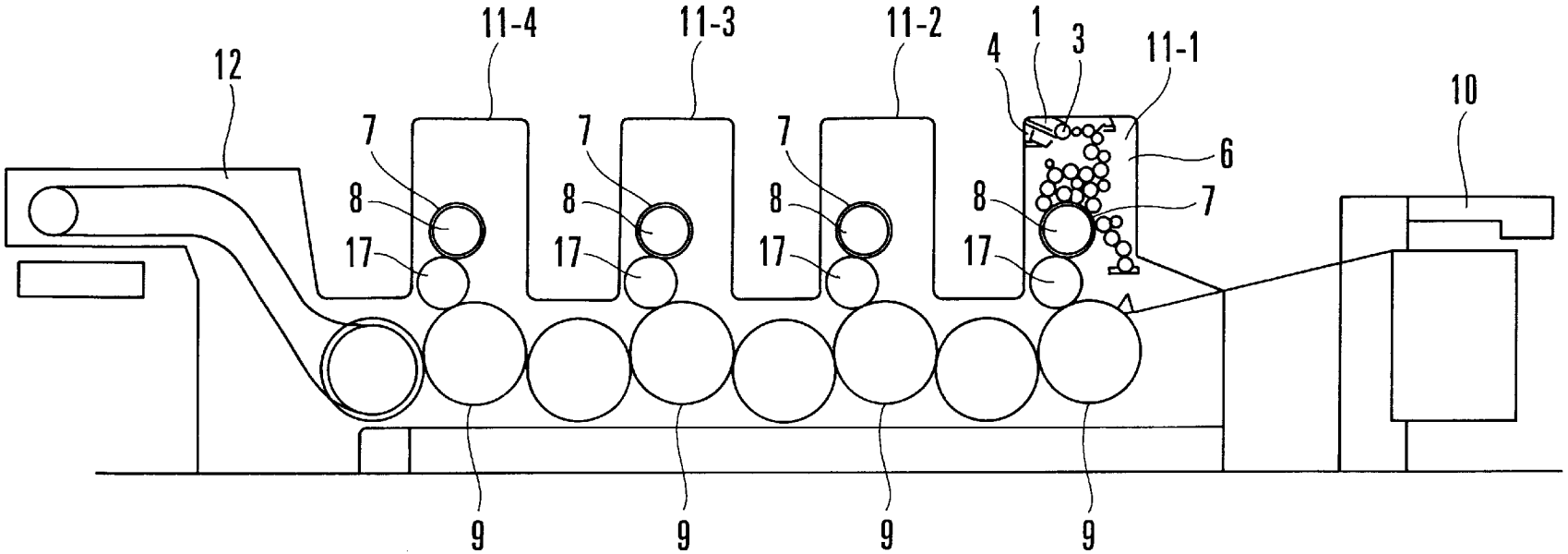
FIG. 2 is a side view showing a four-color rotary printing press to which the present invention is applied.

FIG. 2 shows the schematic arrangement of a four-color rotary printing press (four-color printing press) according to the first embodiment of the present invention. Referring to FIG. 2, reference numerals 11-1 to 11-4 denote printing units. Each of printing units 11-1 to 11-4 has the ink supply apparatus shown in FIG. 8. Reference numeral 9 denotes a blanket cylinder; and 17, an impression cylinder.

Figure 3:
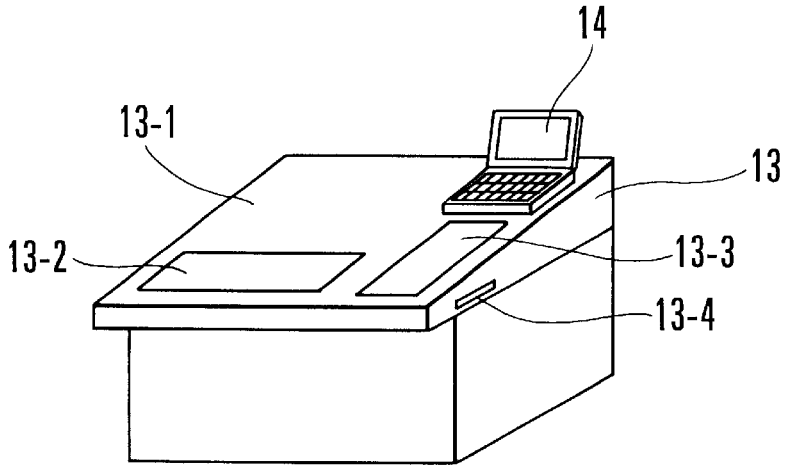
FIG. 3 is a perspective view showing an operation desk prepared for the printing press shown in FIG. 2.

In this four-color printing press, operation desk 13 as shown in FIG. 3 is near delivery section 12. Operation desk 13 has operation panel 13-1 on its upper surface. Operation panel 13-1 has an operation section 13-2 and display section 13-3 on its upper surface. A printing setting unit 14 constructed by a personal computer is mounted on the upper surface of operation desk 13. Operation desk 13 incorporates a control unit (to be described later). The control apparatus and printing setting unit 14 construct a test printing system.

Figure 4A:
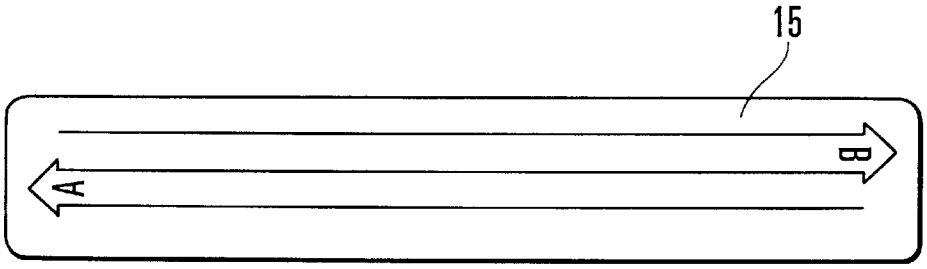
FIGS. 4A and 4B are plan views, respectively, showing a magnetic card and a floppy disk on which print data is recorded.
Figure 4B:
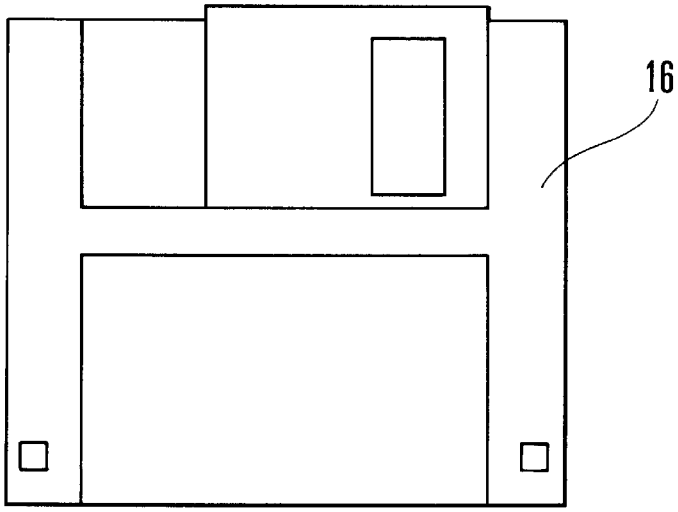

Operation panel 13-1 has a slot 13-4 for receiving recording media such as a magnetic card 15 shown in FIG. 4A or a floppy disk 16 shown in FIG. 4B. Final printing data (print data) prepared on the basis of the image area information of a printing plate is recorded on the recording media. More specifically, set value data such as a printing unit which uses the printing plate, the aperture ratio of the ink fountain key of the printing unit, and the rotation ratio of the ink fountain roller are recorded as final printing data in units of corresponding printing plates.

In printing setting unit 14, to form an optimum ink film thickness on each roller of ink roller group 6, a "pre-inking I", "ink removing", "pre-inking II", "pre-inking (+)", "pre-inking (−)", or "test printing" mode (function) is selected on the menu window.

Figure 5:
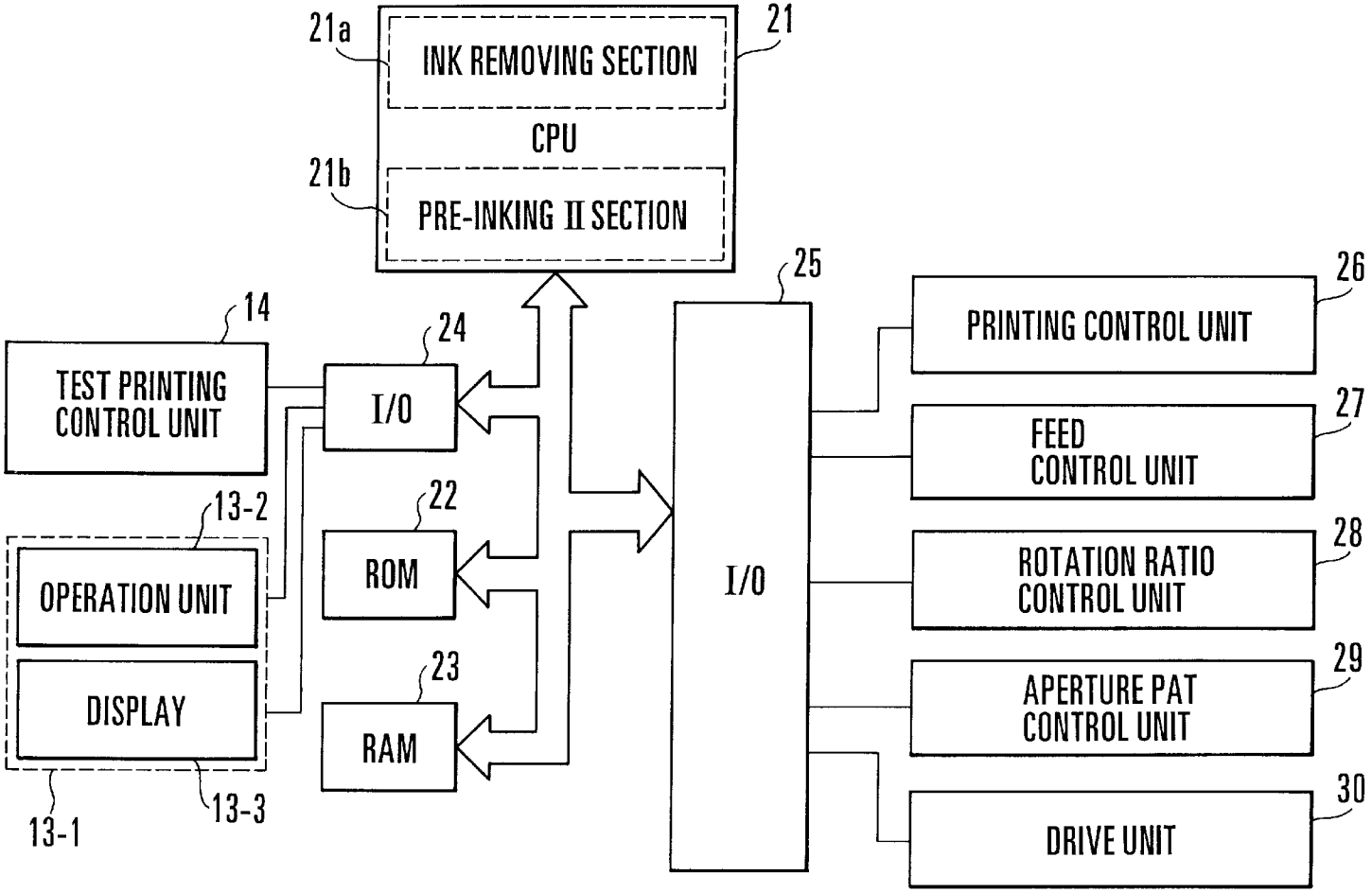
FIG. 5 is a block diagram showing the main part of a printing press including an ink film thickness control apparatus.

FIG. 5 shows the electrical arrangement of the printing press including printing setting unit 14. Referring to FIG. 5, reference numeral 21 denotes a CPU (Central Processing Unit) for performing various processing operations; 22, a ROM (Read Only Memory) storing various programs for executing the respective modes; 23, a RAM (Random Access Memory) for storing various data; 24 and 25, I/O interfaces; 26, a printing control unit for controlling printing by the printing press; 27, a feed control unit for ON/OFF-controlling the feed mechanism for feeding ink; 28, a rotation ratio control unit for controlling the rotation ratio of the fountain roller; 29, an aperture ratio control unit for controlling the aperture ratio of an ink key; and 30, a drive unit for driving a recording medium such as a floppy disk.

I/O interface 24 is connected to operation section 13-2, display section 13-3, and printing setting unit 14. I/O interface 25 is connected to printing control unit 26, feed control unit 27, rotation ratio control unit 28, aperture ratio control unit 29, and drive unit 30. The printing control unit 26, feed control unit 27, rotation ratio control unit 28, and aperture ratio control unit 29 are prepared for each of the printing units 11-1 to 11-4. When a magnetic card is used as a recording medium, a card read unit is connected to I/O interface 25 in place of drive unit 30.

Figure 8:
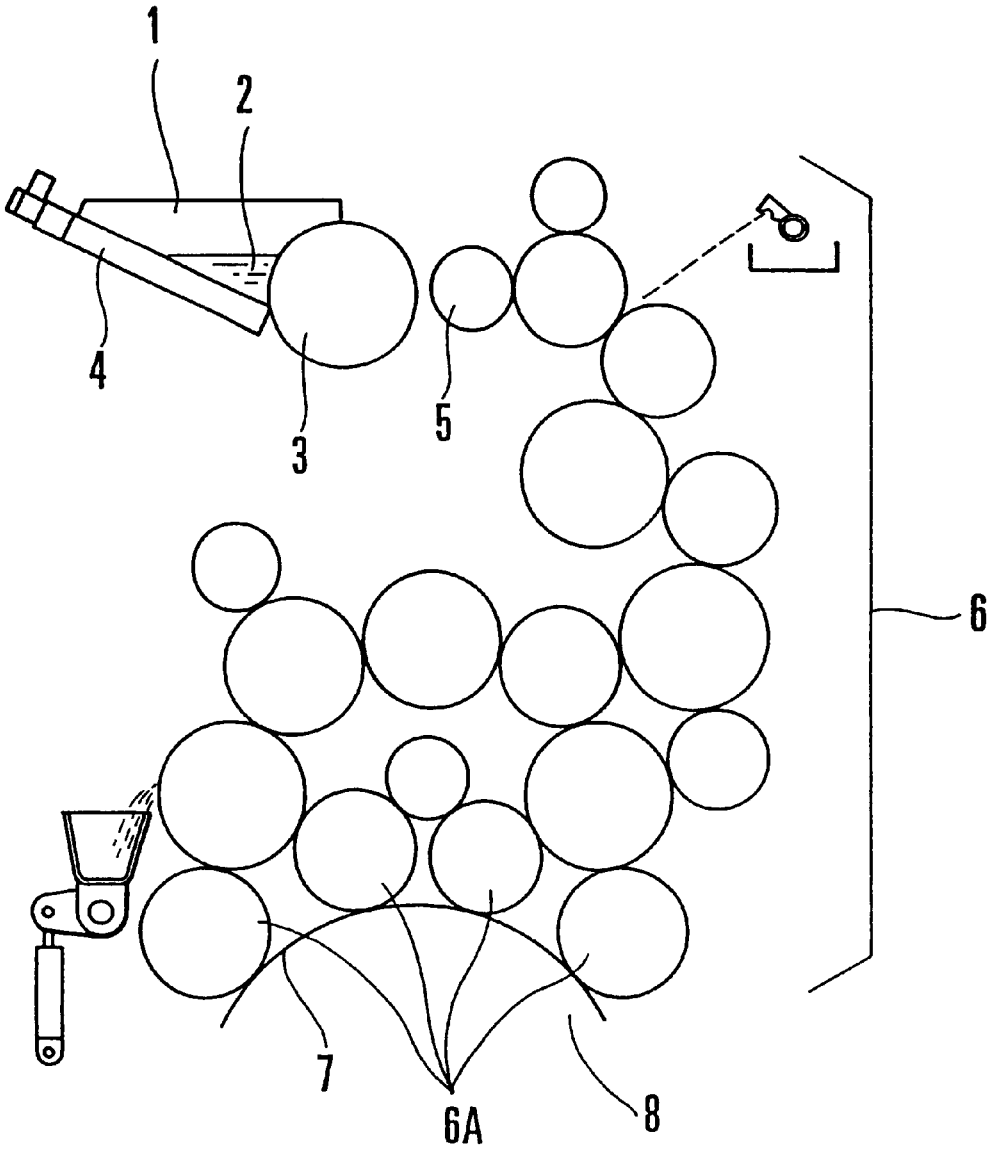
FIG. 8 PRIOR ART
FIG. 8 is a view showing the schematic arrangement of an ink supply apparatus in each printing unit of a printing press.

FIG. 8 shows the main part of an ink supply apparatus in each printing unit (printing section) of a multi-color printing press of the prior art. As discussed in the Description of the Preferred Embodiments, certain methods of the invention are applicable to such a printing press. Referring to FIG. 8, reference numeral 1 denotes an ink fountain; 2, ink stored in ink fountain 1; 3, an ink fountain roller; 4, a plurality of ink fountain keys juxtaposed along the axial direction of ink fountain roller 3; 5, an ink doctor roller; 6, an ink roller group; 6A, ink form rollers in the ink roller group 6; 7, a printing plate; and 8, a plate cylinder.

The printing setting unit 14 selects one of "pre-inking I", "ink removing", "pre-inking II", "pre-inking (+)", "pre-inking (−)", or "test printing" modes (functions) to form an optimum ink film thickness on each roller of ink roller group 6.

In "pre-inking I" mode, after a first ink film thickness distribution Ma is formed, a second ink film thickness distribution Mb is further formed on first ink film thickness distribution Ma. In "ink removing" mode, the first ink film thickness distribution Ma is formed by removing the second ink film thickness distribution Mb. In "pre-inking II" mode, the second ink film thickness distribution Mb is formed on the first ink film thickness distribution Ma which as already been formed. In "pre-inking (+)" and "pre-inking (−)" modes, the second ink film thickness distribution Mb is increased and decreased.

Operation panel 13-1 has slot 13-4 for receiving a recording medium such as magnetic card 15 shown in FIG. 4B or floppy disk 16 shown in FIG. 4B. In this embodiment, a recording medium on which final printing data (print data)

prepared on the basis of the image area information of a printing plate is recorded is set in slot 13-4. More specifically, set value data such as a printing unit which uses the printing plate, the aperture ratio of the ink fountain key of the printing unit, and the rotation ratio of the ink fountain roller are recorded on the recording medium as final printing data. The recording medium may be set in printing setting unit 14 such that printing setting unit 14 can load the final printing data.

Figure 1:
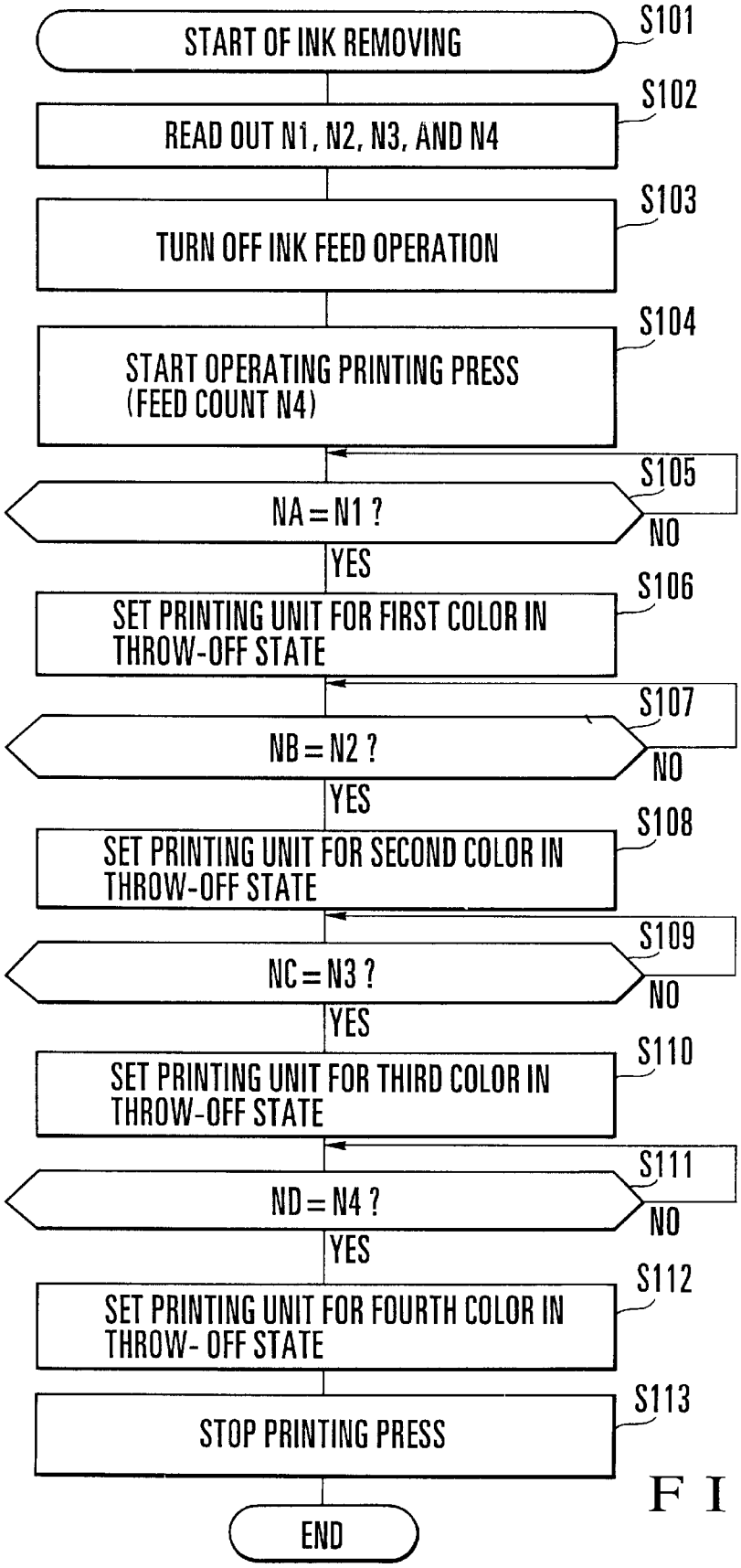
FIG. 1 is a flow chart showing an ink removing operation (throw-off timing control method) according to the first embodiment of the present invention.

An operation of forming an ink film thickness distribution on ink roller group 6 when printing units 11-1 to 11-4 of the four-color printing press with the above arrangement simultaneously exchange printing plates 7 will be described with reference to FIG. 1.

When printing setting unit 14 is powered on, a menu window appears on the display. The menu window displays "pre-inking I", "ink removing", "pre-inking II", "pre-inking (+)", "pre-inking (−)", and "test printing" as selectable modes. Numbers "1" to "4" corresponding to the printing units 11-1 to 11-4, respectively, are also displayed.

A case wherein after the end of final printing, four printing plates in printing units 11-1 to 11-4 are simultaneously changed to new printing plates 7 will be described. In this case, the operator sets in advance, in the menu window on printing setting unit 14, the number of printing sheets (removing count) for "ink removing" in units of printing units 11-1 to 11-4 in consideration of ink trapping.

More specifically, for "ink removing" in one printing unit, the removing count takes a predetermined theoretical value N (the value N changes depending on factors such as ink and blanket). However, when "ink removing" is to be performed simultaneously in a plurality of printing units, the removing count changes in units of printing units due to the difference in ink trapping.

When the printing plates are simultaneously changed to new printing plates 7-1 to 7-4, values N1, N2, N3, and N4 (N4>N3>N2>N1) are set as removing counts for printing units 11-1, 11-2, 11-3, and 11-4, respectively, in consideration of ink trapping. Removing counts N1, N2, N3, and N4 are stored in RAM 23.

Immediately after final printing, the operator sets a recording medium such as magnetic card 15 or floppy disk 16 having print data of new printing plates 7-1 to 7-4 in slot 13-4 of operation panel 13-1, thereby inputting new print data. The input print data of new printing plates 7-1 to 7-4 are transferred to CPU 21 through interface 24 and stored in RAM 23.

<Ink Removing (Throw-Off Timing Control Method)>

"Ink removing" processing is executed by ink removing section 21*a* of CPU 21. This will be described below as processing of CPU 21.

The operator selects numbers "1" to "4" corresponding to printing units 11-1 to 11-4, respectively, in the menu window on printing setting unit 14, and selects "ink removing". That is, the operator instructs printing units 11-1 to 11-4 to start "ink removing" (step S101).

At this time, on ink roller group 6 of each of printing units 11-1 to 11-4, the second ink film thickness distribution Mb corresponding to the image of the previous printing plate remains while being superposed on first ink film thickness distribution Ma by the immediately preceding printing operation.

When start of "ink removing" is instructed, CPU 21 read out removing counts N1, N2, N3, and N4 from RAM 23 (step S102). CPU 21 and printing control unit 26 turn of the feed operation of ink ductor rollers 5 of printing units 11-1 to 11-4. After this, the feed count is set to N4, and the printing press is operated while keeping the previous printing plates mounted (steps S103 and S104). In this case, printing units 11-1 to 11-4 are in the throw-on state.

Printing units 11-1 to 11-4 print printing sheets conveyed from feed section 10. In each of printing units 11-1 to 11-4, printing is performed while keeping the feed operation of ink ductor roller 5 stopped, so ink 2 in each of the printing units 11-1 to 11-4 is not supplied to ink roller group 6.

Figure 7A:
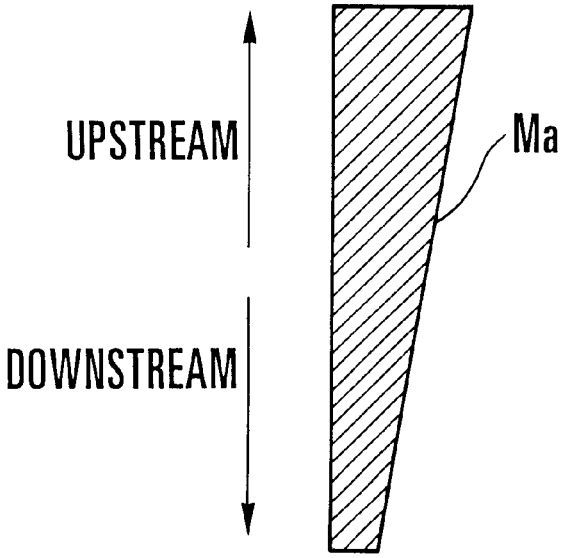
FIGS. 7A and 7B are views respectively showing first and second ink film thickness distributions Ma and Mb formed on an ink roller group.
Figure 7B:
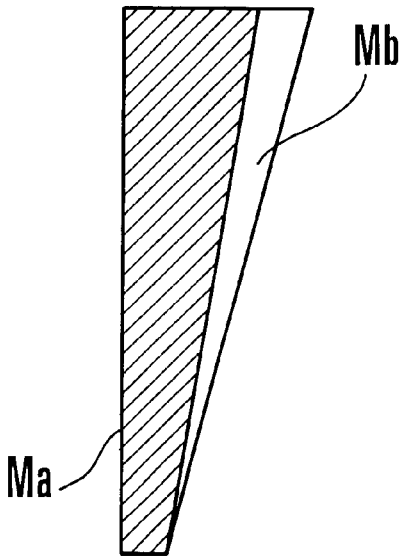

When a print count NA in printing unit 11-1 reaches N1 (step S105), CPU 21 issues a throw-off instruction to printing unit 11-1 (step S106). Printing unit 11-1 is set in the throw-off state. Printing by printing unit 11-1 is interrupted. After this, printing sheets that have passed through printing unit 11-1 without being printed are sent to printing unit 11-2. At this time, of the ink held by ink roller group 6 of printing unit 11-1, only second ink film thickness distribution Mb is consumed by printing for the print count N1. Consequently, the history of ink in ink roller group 6 is canceled, and first ink film thickness distribution Ma (FIG. 7A) common to the previous and new printing plates is left in an appropriate amount.

When a print count NB in printing unit 11-2 reaches N2 (step S107), CPU 21 issues a throw-off instruction to printing unit 11-2 (step S108). Printing unit 11-2 is set in the throw-off state. Printing by printing unit 11-2 is interrupted. After this, printing sheets that have passed through printing units 11-1 and 11-2 without being printed are sent to printing unit 11-3. At this time of the ink held by ink roller group 6 of printing unit 11-2, only the second ink film thickness distribution Mb is consumed by printing for the print count N2. Consequently, the history of ink in ink roller group 6 is canceled, and first ink film thickness distribution Ma is left in an appropriate amount.

When a print count NC in printing unit 11-3 reaches N3 (step S109), CPU 21 issues a throw-off instruction to printing unit 11-3 (step S110). Printing unit 11-3 is set in the throw-off state. Printing by printing unit 11-3 is interrupted. After this, printing sheets that have passed through printing units 11-1, 11-2, and 11-3 without being printed are sent to printing units 11-4. At this time, of the ink held by ink roller group 6 of printing unit 11-3, only the second ink film thickness distribution Mb is consumed by printing for the print count N3. Consequently, the history of ink in ink roller group 6 is canceled, and the first ink film thickness distribution Ma is left in an appropriate amount.

When a print count ND in printing unit 11-4 reaches N4 (step S111), CPU 21 issues a throw-off instruction to printing unit 11-4 (step S112). Printing unit 11-4 is set in the throw-off state. Printing by printing unit 11-4 is interrupted. At this time, of the ink held by ink roller group 6 of printing unit 11-4, only the second ink film thickness distribution Mb is consumed by printing for print count N4. Consequently, the history of ink in ink roller group 6 is canceled, and first ink film thickness distribution Ma is left in an appropriate amount. After this, CPU 21 stops operating the printing press (step S113).

In the above description, throw-on means that plate cylinder 8, blanket cylinder 9, and impression cylinder 17 shown in FIG. 2 are set in the throw-on state (contact state) to start printing. Throw-off means that plate cylinder 8, blanket cylinder 9, and impression cylinder 17 shown in FIG. 2 are set in the throw-off state (separated state) to stop printing.

<Pre-Inking II>

"Pre-inking II" processing is executed by the pre-inking II section 21*b* of CPU 21. This will be described below as processing of CPU 21.

When "ink removing'is ended, and the printing plates are exchanged with new printing plates 7, the operator selects number "1" to "4" corresponding to printing units 11-1 to 11-4, respectively, in the menu window on printing setting unit 14, and selects "pre-inking II". That is, the operator instructs printing units 11-1 to 11-4 to start "pre-inking II".

In this "pre-inking II", CPU 21 presets the aperture ratios of ink fountain keys 4 and the rotation ratios of ink fountain rollers 3 in printing units 11-1 to 11-4 to values corresponding to the images of new printing plates 7 and operates the printing press. In each of printing units 11-1 to 11-4, ink ductor roller 5 is caused to perform the feed operation a predetermined number of times to superpose second ink film thickness distribution Mb on first ink film thickness distribution Ma left on ink roller group 6.

In this case, since first ink film thickness distribution Ma is left on ink roller group 6 of each of printing units 11-1 to 11-4 in an appropriate amount by "ink removing", the second ink film thickness distribution Mb for the next printing operation is accurately formed by "pre-inking II", and waste paper can be suppressed.

The second embodiment of the present invention will be described next.

<Ink Removing (Throw-On Timing Control Method)>

In the first embodiment, in "ink removing", printing units 11-1 to 11-4 are simultaneously set in the throw-on state, and then, the throw-off timing is controlled in units of printing units 11-1 to 11-4. However, the printing units may be simultaneously set in the throw-off state after the throw-on timing is controlled in units of printing units.

Figure 6:
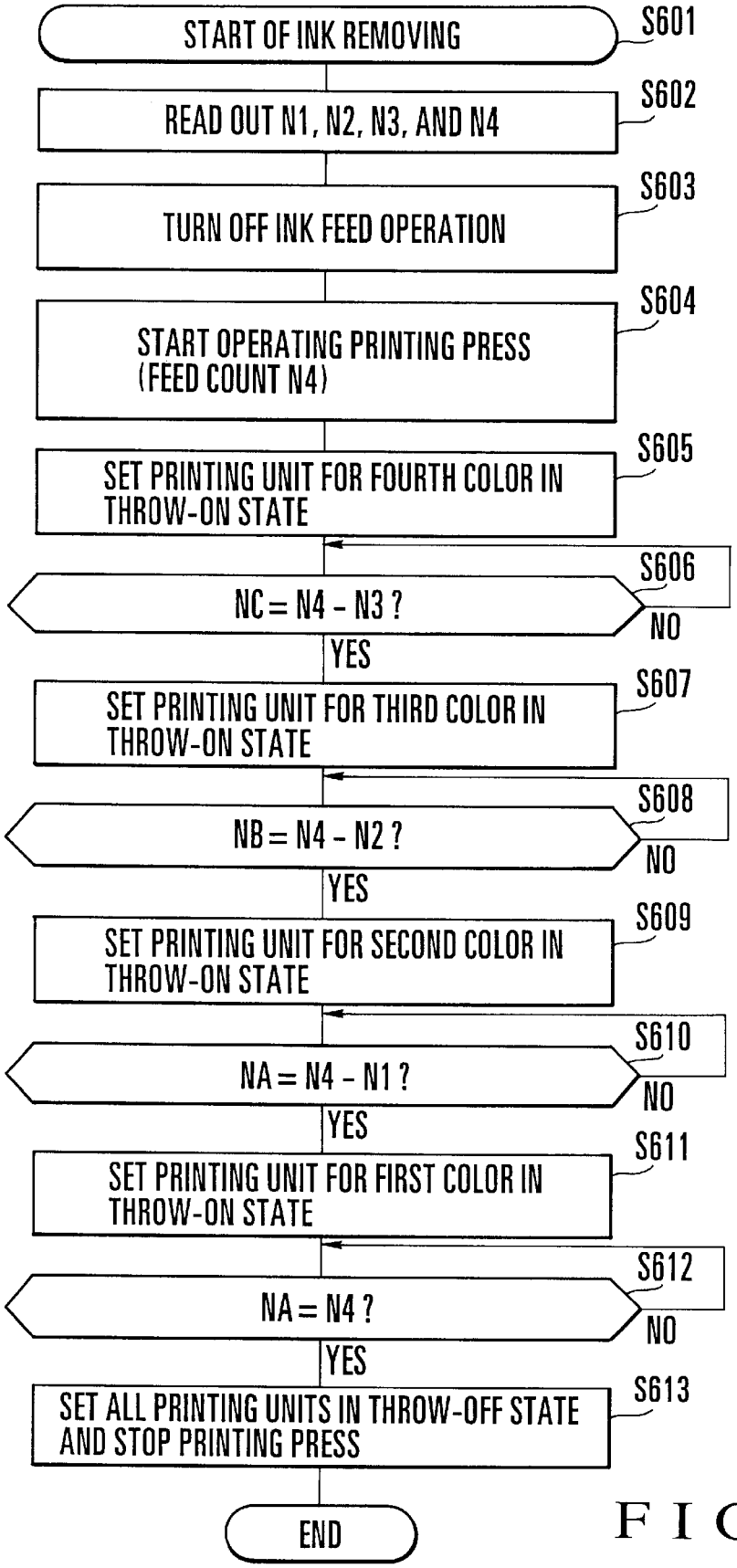
FIG. 6 is a flow chart showing an ink removing operation (throw-on timing control method) according to the second embodiment of the present invention.

A case wherein the throw-on timing is controlled will be described below with reference to FIG. 6.

The operator selects numbers "1" to "4" corresponding to printing units 11-1 to 11-4, respectively, in the menu window on printing setting unit 14, and selects "ink removing". That is, the operator instructs printing units 11-1 to 11-4 to start "ink removing" (step S601).

At this time, on ink roller group 6 of each of printing units 11-1 to 11-4, a second ink film thickness distribution Mb corresponding to the image of the previous printing plate is superposed on a first ink film thickness distribution Ma.

When start of "ink removing" is instructed, CPU 21 reads out removing counts N1, N2, N3, and N4 from RAM 23 (step S602). CPU 21 turns off the feed operation of ink ductor rollers 5 of printing units 11-1 to 11-4. After this, the feed count is set to N4, and the printing press is operated while keeping the previous printing plates mounted (steps S603 and S604). In this case, printing units 11-1 to 11-4 are in the throw-off state.

After the start of operation of the printing press, CPU 21 issues a throw-on instruction to printing unit 11-4 (step S605). Printing units 11-1 to 11-3 are set in the throw-off state, and printing unit 11-4 is in the throw-on state. Printing unit 11-4 starts printing sheets that have passed through printing units 11-1 to 11-3 without being printed.

When a pass count NC of printing sheets in printing unit 11-3 reaches N4-N3 (step S606), CPU 21 issues a throw-on instruction to printing unit 11-3 (step S607). Printing unit 11-3 is set in the throw-on state and starts printing sheets that have passed through printing units 11-1 and 11-2 without being printed.

When a pass count NB of printing sheets in printing unit 11-2 reaches N4-N2 (step S608), CPU 21 issues a throw-on instruction to printing unit 11-2 (step S609). Printing unit 11-2 is set in the throw-on state and starts printing sheets that have passed through printing unit 11-1 without being printed.

When a pass count NA of printing sheets in printing unit 11-1 reaches N4-N1 (step S610), CPU 21 issues a throw-on instruction to printing unit 11-1 (step S611). Printing unit 11-1 is set in the throw-on state and starts printing sheets sent from feed section 10.

When the print count NA in printing unit 11-4 reaches "N4" (step S612), CPU 21 issues a throw-off instruction to printing units 11-1 to 11-4 and stops operating the printing press (step S613).

In printing unit 11-1, the "(N4–N1)+1"th to "N4"th printing sheets, i.e., N1 printing sheets are printed while keeping the feed operation of ink ductor roller 5 stopped. As a result, the history of ink in ink roller group 6 is canceled, and first ink film thickness distribution Ma is left in an appropriate amount.

In printing unit 11-2, the "(N4–N2)+1"th to "N4"th printing sheets, i.e., N2 printing sheets are printed while keeping the feed operation of ink ductor roller 5 stopped. As a result, the history of ink in ink roller group 6 is canceled, and first ink film thickness distribution Ma is left in an appropriate amount.

In printing unit 11-3, the "(N4–N3)+1"th to "N4"th printing sheets, i.e., N3 printing sheets are printed while keeping the feed operation of ink ductor roller 5 stopped. As a result, the history of ink in ink roller group 6 is canceled, and first ink film thickness distribution Ma is left in an appropriate amount.

In printing unit 11-4, the "1"st to "N4"th printing sheets, i.e., N4 printing sheets are printed while keeping the feed operation of ink ductor roller 5 stopped. As a result, the history of ink in ink roller group 6 is canceled, and first ink film thickness distribution Ma is left in an appropriate amount.

<Ink Removing (Throw-On/Off Timing Control Method for Ink Form Roller)>

In the above embodiments, in ink removing, the throw-on or throw-off timing of each of printing units 11-1 to 11-4 is controlled. However, throw-on or throw-off of an ink form roller 6A of each of printing units 11-1 to 11-4 may be controlled at the same timing as the throw-on or throw-off timing shown in FIG. 1 or 6.

In the above embodiments, the printing plates of the four-color printing units are simultaneously exchanged. However, the present invention can also be applied to a case wherein printing plates of two- or three-color printing units are exchanged.

As has been described above, according to the present invention, when printing plates of a plurality of printing units are exchanged, the number of printing sheets to be used for ink removing is set in units of printing units which exchange the printing plates. Minimum ink necessary for printing can be left in an appropriate amount on the ink roller group of each printing unit which exchanges the printing plate. With this arrangement, an ink film thickness distribution for the next job can be accurately formed, and waste paper can be suppressed.

What is claimed is:

1. An ink film thickness control method for a multi-color printing press having a plurality of printing units, each continuously performing designated color printing on printing sheets by means of ink supplied to a printing plate through an ink roller group, comprising the steps of:

setting the number of printing sheets to be printed for ink removing in units of said printing units, when printing plates are exchanged;

turning off an ink feed operation in each of said printing units;

performing printing for ink removing in each of said printing units on the basis of the set number of printing sheets while keeping the previous printing plate mounted to form a first ink film thickness distribution necessary for printing on said ink roller group.

2. An ink film thickness control apparatus for a multicolor printing press having a plurality of printing units for continuously performing designated color printing on printing sheets by means of ink supplied to a printing plate through an ink roller group, comprising:

setting means for setting the number of printing sheets to be printed for ink removing in units of said printing units, when printing plates are exchanged;

control means for turning off an ink feed operation in each of said printing units;

an ink removing means for removing ink in each of said printing units on the basis of the set number of printing papers while keeping the previous printing plate mounted to form a first ink film thickness distribution necessary for printing on said ink roller group.

3. An ink film thickness control method for a multi-color printing press having a plurality of printing units, each continuously performing designated color printing on printing sheets by means of ink supplied to a printing plate through an ink roller group, comprising the steps of:

setting the number of printing sheets to be printed for ink removing in units of at least two of said printing units, as plate exchange printing units, when printing plates are exchanged;

turning off an ink feed operation in each of said plate exchange printing units;

performing printing for ink removing in each of said plate exchange printing units on the basis of the set number of printing sheets while keeping the previous printing plate mounted to form a first ink film thickness distribution necessary for printing on said ink roller group.

4. A method according to claim 3, further comprising the steps of:

exchanging the previous printing plate with a new printing plate in each of said plate exchange printing units after the first ink film thickness distribution is formed; and superposing second ink film thickness distribution corresponding to an image of the new printing plate on the first ink film thickness distribution formed on said ink roller group in each of said plate exchange printing units by operating said printing press after the printing plates are exchanged at said plate printing exchange units.

5. A method according to claim 3, further comprising the steps of:

starting unit printing in all of said plate exchange printing units in a throw-on state; and setting each of said plate exchange printing units in a throw-off state in ascending order of the set number of printing sheets to sequentially stop unit printing.

6. A method according to claim 5, wherein the step of stopping unit printing comprises the steps of:

determining whether an actual print count of each of said plate exchange printing units reaches the set number of printing sheets in ascending order of the set number of printing sheets; and setting each of plate exchange printing units in the throw-off state, when the actual print count reaches the set number of printing sheets.

7. A method according to claim 3, further comprising the steps of:

setting each of said plate exchange printing unit in a throw-on state in descending order of the set number of printing sheets to sequentially start unit printing; and simultaneously setting all of said plate exchange printing units in a throw-off state to stop unit printing.

8. A method according to claim 7, wherein the step of starting unit printing comprises the steps of:

determining whether the remaining print count in each of said plate exchange printing units reaches the set number of printing sheets in descending order of the set number of printing sheets; and setting each of said plate exchange printing units in the throw-on state, when the remaining print count reaches the set number of printing sheets.

9. A method according to claim 3, wherein said printing unit comprises a plurality of ink fountain keys, which adjust ink amount supplied from an ink fountain, and ink fountain roller which supplies ink from said ink fountain keys by rotation thereof, and an ink ductor roller which supplies ink from said ink fountain roller to said ink roller group by a feed operation thereof, and further comprising the steps of exchanging the previous printing plate with a new printing plate in each of the plate exchange printing units, after the first ink film thickness distribution is formed pre-setting the aperture ratios of said ink fountain keys and a rotation ratio of said ink fountain roller of said plate exchange printing unit to values corresponding to an image of the new printing plate;

operating said printing press to cause said ink ductor roller of said plate exchange printing unit to perform the feed operation a predetermined number of times; and superposing a second ink film thickness distribution corresponding to the image of the new printing plate on the first ink film thickness distribution left on said ink roller group.

10. A method according to claim 3, further comprising the steps of:

designating said plate exchange printing units from said printing units; and selecting an ink removing mode from a plurality of modes.

11. An ink film thickness control apparatus for a multi-color printing press having a plurality of printing units for continuously performing designated color printing on printing sheets by means of ink supplied to a printing plate through an ink roller group, comprising:

setting means for setting the number of printing sheets to be printed for ink removing in units of at least two of said printing units, as plate exchange printing plates, when printing plates are exchanged;

control means for turning off an ink feed operation in each of said plate exchange printing units;

an ink removing means for removing ink in each of said plate exchange printing units on the basis of the set number of printing papers while keeping the previous printing plate mounted to form a first ink film thickness distribution necessary for printing on said ink roller group.

12. A apparatus according to claim 11, further comprising:

pre-inking means for, after the first ink film thickness distribution is formed, superposing a second ink film thickness distribution corresponding to an image of the new printing plate on the first ink film thickness distribution formed on said ink roller group in each of said plate exchange printing units by operating said printing press while keeping the new printing plate mounted.

13. An apparatus according to claim 11, wherein said ink removing means starts unit printing in all of said plate exchange printing units in a throw-on state and then sets each of said plate exchange printing units in a throw-off state in ascending order of the set number of printing sheets to sequentially stop unit printing.

14. An apparatus according to claim 11, wherein said ink removing means sets each of said plate exchange printing units in a throw-on state in descending order of the set number of the printing sheets to sequentially start unit printing and then simultaneously sets all of said plate exchange printing units in a throw-off state to stop unit printing.

* * * * *